United States Patent [19]

Dameron, Jr. et al.

[11] 4,280,857

[45] Jul. 28, 1981

[54] CONTINUOUS DRAW ANNEAL SYSTEM

[75] Inventors: H. Clifford Dameron, Jr., Ross Township, Allegheny County; Nicholaas L. Brouwer, Washington Township, Fayette County; Guy E. Martin, Ross Township, Allegheny County, all of Pa.

[73] Assignee: Aluminum Company of America, Pittsburgh, Pa.

[21] Appl. No.: 91,136

[22] Filed: Nov. 5, 1979

[51] Int. Cl.[3] ..... B21C 9/00; C21D 8/06; C21D 9/62

[52] U.S. Cl. ..... 148/156; 72/286; 148/13; 148/128; 219/155; 266/87; 266/104

[58] Field of Search ..... 266/78, 87, 102, 103, 266/104, 113, 115; 148/2, 11.5 A, 12 R, 12 B, 128, 134, 153, 154, 156, 13 R; 72/286; 219/155

[56] References Cited

U.S. PATENT DOCUMENTS

| | | | |
|---|---|---|---|
| 2,933,424 | 4/1960 | Canney | 148/12 B |
| 2,994,328 | 8/1961 | Lewis | 266/113 X |
| 3,604,234 | 9/1971 | Hinrichsen | 266/113 X |
| 3,613,418 | 10/1971 | Nara et al. | 266/113 X |
| 3,630,057 | 12/1971 | Strohmeier | 72/286 X |
| 3,682,723 | 8/1972 | Reikkinen | 266/104 X |
| 3,779,054 | 12/1973 | Greenberger | 266/113 X |
| 3,826,690 | 7/1974 | Bleinberger et al. | 148/11.5 A |
| 3,952,571 | 4/1976 | Yokota et al. | 148/11.5 A X |
| 4,036,046 | 7/1977 | Davies et al. | 72/286 |
| 4,151,896 | 5/1979 | Nicoud et al. | 148/2 |

FOREIGN PATENT DOCUMENTS

| | | | |
|---|---|---|---|
| 1558795 | 4/1970 | Fed. Rep. of Germany | 148/156 |
| 2414015 | 10/1974 | Fed. Rep. of Germany | 148/156 |

*Primary Examiner*—Peter K. Skiff
*Attorney, Agent, or Firm*—Elroy Strickland

[57] ABSTRACT

An apparatus and method of continuously drawing and annealing wire in a slip mode. The method comprises the steps of directing a wire successively through a plurality of drawing dies of a continuous wire drawing machine, and from the next to the last die of the machine continuously directing the wire to and through apparatus for annealing the wire. From the annealing apparatus the wire is continuously returned to the machine for a final drawing operation. Before the wire is returned to the machine, however, the temperature of the wire is controlled to provide the wire with metallurgical properties suitable for further processing, such as the final drawing operation.

3 Claims, 2 Drawing Figures

CONTINUOUS DRAW ANNEAL SYSTEM

BACKGROUND OF THE INVENTION

The present invention relates generally to the continuous annealing of drawn wire, and particularly to the process of slip drawing wire in a multi-draw machine and then sending the wire directly and continuously to an annealing apparatus, operating in a slip mode, before the wire is finally drawn and processed.

Generally, drawn wire is formed into a package by being wound on a container, such as a reel or spool, or coiled in a hollow manner without a container. One of the more common ways of annealing the package (either partial or full annealing) is to place the package in a furnace. Depending upon the metal and desired characteristics of the wire, the furnace may or may not have a controlled atmosphere, may or may not have the products of combustion in the furnace atmosphere, and the heat provided in the furnace may come from a variety of sources. The package including the wire is heated to a temperature sufficient to anneal the wire. The package remains in the furnace for a period of time sufficient to allow the heat within the furnace to penetrate the entire amount of wire in the package so that all the wire attains the annealing temperature. After this, the package may be discharged from the furnace, to cool naturally, or means may be used to effect a more rapid rate of cooling; or, the package may be cooled in the furnace to a specified temperature and then discharged from the furnace and cooled further. In any case, the package is cooled to a temperature that allows handling of the package.

It can be appreciated that these processes take a considerable amount of time and energy, as there is substantial time involved in heating the package and wire up to annealing temperature, additional time for the total package to reach thermal equilibrium, and finally the needed time for cooling either outside or inside the furnace. Further, energy is wasted in heating the container, as no purpose is served in heating the container. In addition, the heating and cooling of the total package metallurgically weakens the container such that container life is shortened; hence, replacement costs for the package are involved when using annealing furnaces.

It is, however, not unknown to continuously anneal wire in cooperation with a continuous drawing operation. In U.S. Pat. No. 3,630,057 to Strohmeier, a plurality of components are slaved together, in tandem, to continuously draw and anneal steel wire, before a final drawing operation (at a location remote from the initial drawing operation), after the wire has undergone a pickling process and copper plating. Slaving is effected by a drive 10 which functions as an accumulator, "The wire 16 which leaves . . . drive 10 is virtually under no tension and is . . . passed with the aid of rollers through . . . bath 11", column 2, lines 56 to 59. From bath 11, the wire is directed to "a drawing unit 12 which has a speed of operation that is variable.", column 2, lines 70 and 71. Hence, the operation of Strohmeier appears to be a non-slipping one, as a slipping process does not need accumulating devices in the line. Rather, overall speed of a slip process is set by a final capstan driven by the slip-type drawing machine.

A system similar to the above Strohmeier patent is shown in U.S. Pat. No. 3,826,690 to Bleinberger et al, in which a multi-draw machine produces aluminum wire continuously for an annealing process involving electromagnetic coupling using a transformer and a loop of the wire. An intermediate cleaning process is included, and a single draw of the wire is made at a location separate from the drawing machine and before the wire is directed to an extruding head for insulating the wire. Again, as in the case of the Strohmeier patent, the individual components and processes are slaved together in a tandem, non-slip manner using an accumulator 29 to control wire tension between drawing and annealing.

U.S. Pat. No. 3,779,055 to Goyffon shows a slip drawing machine continuously feeding wire to enameling apparatus from the last die of the machine. There is no final drawing operation, as in Strohmeier and Bleinberger et al, and Goyffon is concerned with permitting the enameling machine to govern the overall speed of the two devices without rigid synchronization between the two. In this manner, independent operation of the two processes is also provided.

BRIEF SUMMARY OF THE INVENTION

The present invention is directed to continuous wire drawing, using a conventional slip drawing machine, in combination with continuous annealing apparatus in which slipping occurs between the wire and sheaves of the apparatus employed to apply a heating current to the wire. Wire travels directly to the annealing apparatus from the next to last die of the wire drawing machine, and returns to the last die of the machine so that all processing of the wire takes place between the entrance and exit dies of the machine and hence within the slip profile of the machine. In all processes of the invention, a common slip mode of operation is employed, the speed of a final pulling capstan setting the slip profile of the operation. Such an operation is highly efficient and economical, as it requires no separate means to effect speed synchronization of the drawing machine and annealing apparatus, as wire is directed through the system in sole response to the demand for wire provided by the final capstan.

The method and apparatus of the invention include means for lowering the temperature level of wire in a controlled and predictable manner from the level attained in the annealer to a predetermined lower level, after the wire leaves the annealer, this lower temperature level providing the wire with metallurgical properties suitable for further working. This lower temperature level, in addition, provides the wire with appropriate metallurgical properties after it is spooled.

THE DRAWINGS

The advantages and objectives of the invention will be better understood by consideration of the following detailed description and the accompanying drawings in which.

PREFERRED EMBODIMENT OF THE INVENTION

Figure 1:
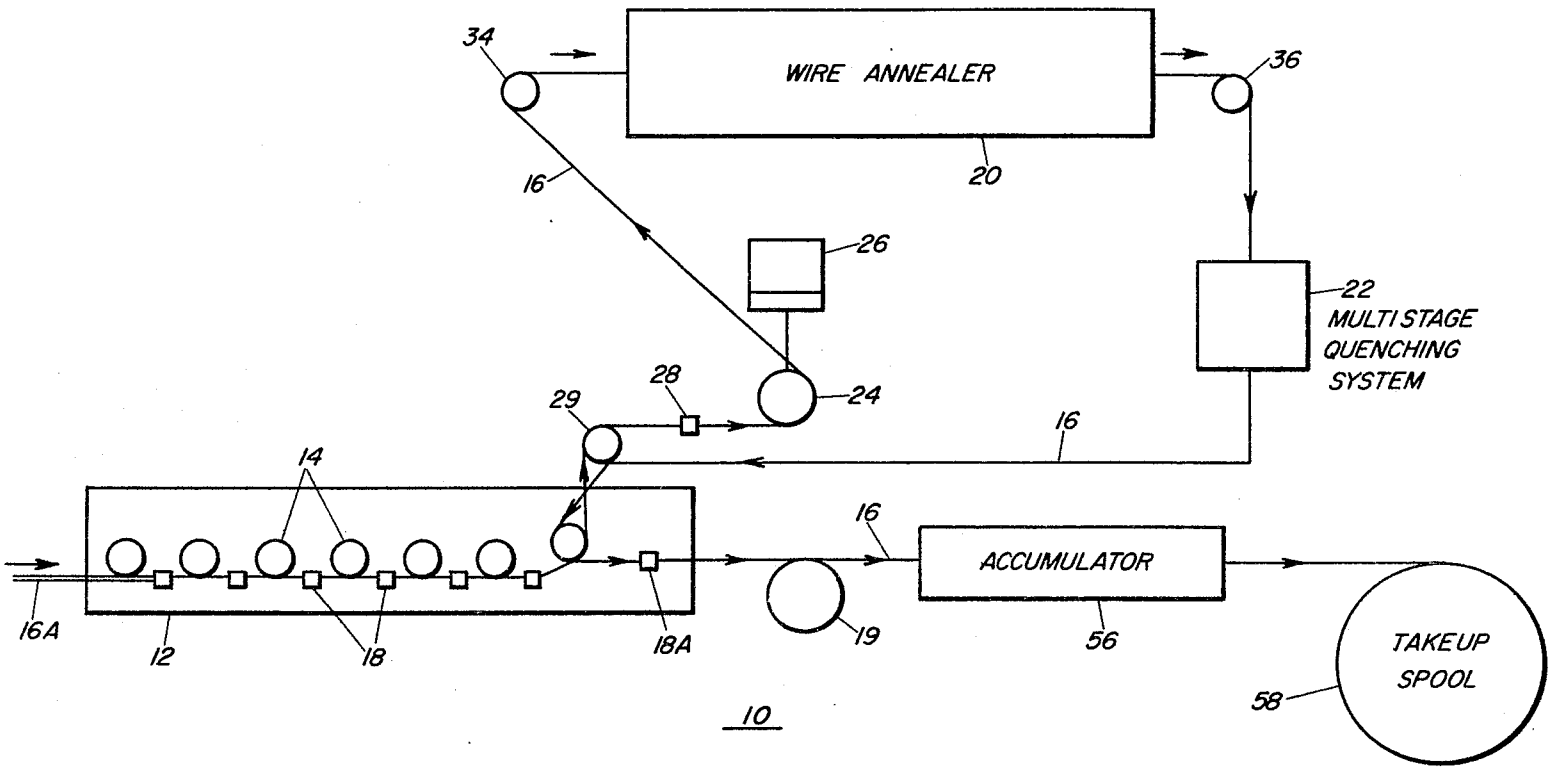
FIG. 1 is a diagrammatic view of the apparatus of the invention.

Referring now to FIG. 1 of the drawings, numeral 10 refers generally to a method and apparatus for continuously slip drawing and annealing wire. More particularly, 10 includes a conventional multi-draw, slip-type machine 12 in which a rod 16A of metal is pulled into the machine (at the left in FIG. 1) by the first one of a series of capstans 14. The first capstan directs the rod material to the first one of a series of dies 18, the first die of the series reducing the cross section of the rod material to a "wire" size, i.e. to wire 16. The remaining dies successively reduce the cross section of wire 16, as the wire is pulled through the dies.

The demand for wire 16 is established by the rotation of a main capstan 19 located in a position to pull the wire from the last die (18A) of the drawing machine. Capstan 19 is operated by the drive of the drawing machine in a non-slip manner, with turns of the wire being wrapped around the capstan.

In combination with drawing machine 12, still referring to FIG. 1, is means 20 for continuously annealing wire 16, as it proceeds from the machine, and a multistage cooling or quenching apparatus 22 adapted, as explained in detail hereinafter, to lower and control the temperature of the wire continuously exiting annealing means 20 to a preset temperature value providing the wire with certain desired metallurgical characteristics.

In the process and apparatus of the invention, as thus far described, wire 16 travels directly from the next to the last drawing die of machine 12 to annealer 20. In going directly to the annealer, the wire, however, is coated with the oil that is used to lubricate the wire, as it is drawn into and through each die 18. If this oil or lubricant is allowed to remain on the wire when the wire reaches the annealer, the oil is heated with the wire, to wire annealing temperature, which causes the oil to vaporize in the form of dense smoke. Such smoke is an environmental problem that must be cared for by removing the smoke from the area of apparatus and the building in which the apparatus is housed. This requires the use of appropriate, and often costly, smoke exhausting equipment.

For this reason, it is preferable to remove the drawing lubricant from the wire before the wire reaches annealer 20. Apparatus for doing this may be a bath or spray of solvent material, for example, through which the wire is directed, or other oil removing means can be employed. In the present disclosure, a die 28 and a capstan 24, for pulling wire 16 through the die, have been found to be an effective, economical way to remove the major portion of the drawing oil from the wire. Die 28 and capstan 24 are located between the next to the last die of drawing machine 12 and the input of annealer 20. Capstan 24 is driven by a motor and clutch arrangement 26. Without capstan 24 and motor-clutch 26, wire 16 is pulled through the cleaning die by sheaves of annealer 20, discussed below, and by the final pulling capstan 19. This would result in excessive elongation of the wire and wire breakage, as the wire is hot in the annealer and hence is in a relatively soft condition.

In order to provide proper tension on the wire directed to annealer 20, however, capstan 24 is not operable to overcome all of the drag on the wire imposed by die 28. Rather, capstan 24 is driven by the clutch of 26 to overcome some major portion of the drag of 28, with the remaining minor portion of the drag being overcome by the pull of annealer 20, i.e. by sheaves of the annealer, discussed below. This is accomplished by slipping the clutch of 26 in a manner that provides capstan 24 with a pulling force slightly below the force needed to pull the wire through 28. Then, when demand for wire is offered by the pull of main capstan 19, the pulling force of the two, i.e. of capstan 24 and the annealer, is immediately sufficient to overcome the drag of die 28 and thereby effect translation of wire 16 through die 28.

Between die 28 and the last capstan of machine 12 is a sheave 29 which functions to handle wire 16 coming from the machine and returning to the machine.

Figure 2:
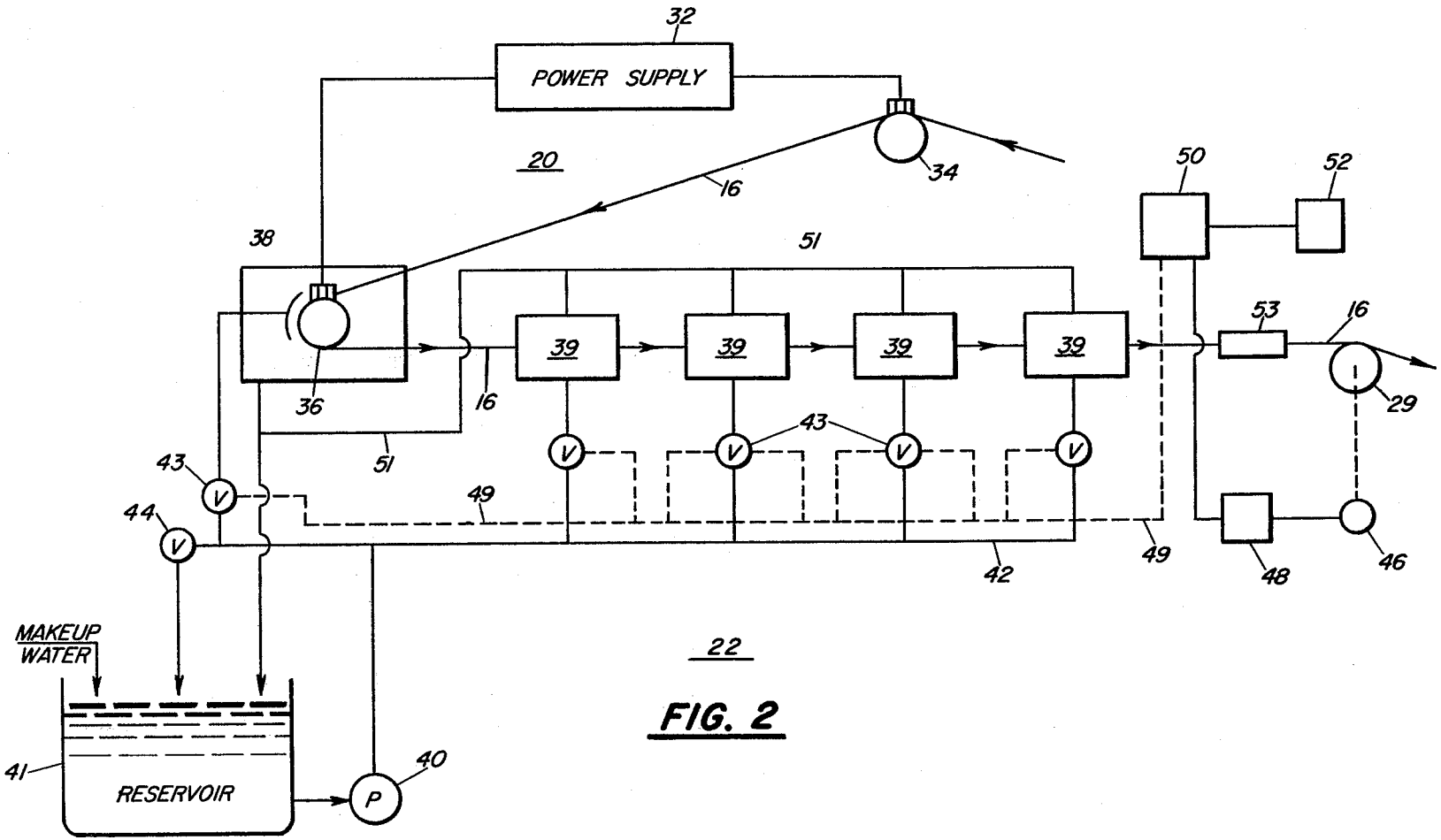
FIG. 2 is a diagrammatic representation of an electrical heating and water cooling system employed in the apparatus of FIG. 1.

FIG. 2 of the drawings shows, diagrammatically, certain details of the annealer 20 (in FIG. 1), such details being given by way of example only. As depicted in FIG. 2, 20 is an electrical means that includes a power supply 32 connected between two sheaves 34 and 36. When traveling through annealer 20, wire 16 is in physical and electrical contact with the sheaves. The sheaves place the voltage of the supply across that length of wire extending between the sheaves in any given instant of time to heat and anneal the wire. Such heating means may be other than an electrical system, as the sole purpose of 20 is to provide annealing of the wire before it returns to drawing machine 12 (FIG. 1).

The quenching means 22 of the invention, as shown diagrammatically in FIG. 2, includes a water spray box or compartment 38 located around the last sheave 36 of the annealing apparatus, followed by four water spray compartments 39, all fed from a reservoir 41 of water, such as available plant water, by a pump 40. The number of such compartments is given by way of example only, as the amount of cooling effected in such compartments is dependent upon the design of the spray nozzles (not shown) within each compartment, the volume, pressure and temperature of the water involved, the rate of travel of wire 16 through the compartments, the size and properties of the wire, etc. The wire, as it travels over the last sheave of the annealer is cooled because the temperature here tends to be highest, the temperature of wire 16 increasing in the process of moving through the annealer.

Pump 40 supplies water to quenching compartments 38 and 39 through a common supply pipe or manifold 42 and individual control valves 43, for the respective compartments, at a volume and pressure sufficient for a selected quenching performance. Pump 40, in addition, returns water to reservoir 41 via a bypass valve 44. The purpose of valve 44 is to provide a head pressure for control valves 43 that is (again) appropriate for a selected quenching performance. Hence, valve 44 is preset to allow a predetermined portion of the water pumped by pump 40 to return to the reservoir.

Control valves 43 are initially manually activated in the process of choosing the number of compartments for a particular cooling operation, depending (again) on the various parameters involved. The control valve for sheave compartment 38, however, is always activated to insure cooling of sheave 36. Valves 43 are, in turn, automatically controllable for purposes of obtaining a proper heating profile for the start-up, steady state and conclusion of the draw-anneal operation, through operation of the valve for the sheave compartment is preferably delayed.

The valves 43 for those compartments chosen to operate for a particular draw-anneal operation are automatically controlled to regulate the volume and pressure of water flowing to the compartments when the operation is started in response to wire speed through the system. By controlling water flow and thus the cooling effected thereby, the temperature of the wire rises rapidly to a preset steady-state value as the speed of the wire through the system increases from zero to a steady-state or run speed.

This is accomplished, in FIG. 2, by measuring the rate of rotation of sheave 29 with a tachometer 46 coupled to sheave 29, and electronic means 48 connected to the tachometer for converting the output of the tachometer to a signal appropriate for utilization by an electrical controller 50. 50 is a commercially available electrical control device capable of producing an output signal that can be used by a mechanism of each valve to change the volume of water passing through each valve. More particularly, 50 is manually presetable to provide control signals for valves 43 that will maintain the temperature of wire 16 issuing from the quenching unit 22 within a selected temperature range after the wire attains a steady-state or run speed. 50 does this by ordering an increase in water flow to the quenching compartments when wire temperature rises above a preset limit, and by ordering a reduction in water flow when wire temperature falls below a preset limit.

In addition, controller 50 is operable to limit the flow of water through valves 43 during the time the wire is accelerating to run speed from zero speed, as discussed briefly above. This is accomplished by 50 acting upon signals from tachometer converter 48, 48 sensing the speed of sheave 29. As the rate of wire travel increases toward a steady-state value, with the tachometer directing signals indicative of this increasing rate to 50, 50, in turn, orders valves 43 to increase the volume of water to the compartments so that the rapid increase in wire temperature smoothly levels off to a steady-state temperature value, without overshooting the desired value of temperature.

In a similar manner, when the operation begins to slow for the end of a run, the valves 43 are ordered by 50, in response to the slowing of wire travel sensed by the tachometer, to provide a flow of water to the compartments that will maintain the steady-state temperature of the wire leaving the last compartment 39 until the run of wire is completed. In this manner, the portions of wire that are heated (annealed) at the beginning and end of the run are provided with the predetermined temperature necessary to allow further processing without cold-working and hardening of the wire. Otherwise, the beginning and ending portions of wire 16 would have to be discarded because of inadequate annealing and/or inadequate metallurgical properties.

The steady-state temperature of the wire for normal run speed is controlled by a device 52 that senses wire temperature. Sensing device 52 is located to read the temperature of the wire after it leaves the last quenching compartment 39. The volume of water spray, and thus the rate of cooling in 38 and 39, are controlled in accordance with the readings of 52. This is accomplished by 52 outputting a signal proportional to wire temperature to controller 50. The controller, reading the temperature of the wire from 52, provides a control signal that is directed to valves 43 to maintain wire temperature within the range preset in 50 and hence at a value suitable for working in the final draw of machine 12.

The connection between controller 50 and valves 43 is indicated in FIG. 2 by a dash line 49, whereas the plumbing for carrying quenching water is shown by solid lines.

Sensing device 52 may be a commercially available optical radiometer, though other means can be employed to read wire temperature without departing from the spirit and scope of the invention.

A line 51 is provided to return the water from compartments 39 to reservoir 41.

Further, a set of air nozzles is represented by box 53, the nozzles being located adjacent the exit end of the last spray compartment for "wiping" the wire free of any moisture and water remaining on the wire after it leaves the last of the spray compartments. To prevent substantial amounts of the cooling media from exiting the last compartment 39, with the wire exiting the compartment, the cooling spray jets in the last compartment can be directed against the wire in a direction opposite to the travel direction of the wire. This enhances substantially the wiping and drying operations in 53.

The operation of the apparatus and system thus far described is as follows. As indicated earlier, a rod 16A of a relatively large diameter is entered into the drawing machine of 12 (in FIG. 1) and is continuously reduced in diameter by the successive dies 18 of the machine. The rod, which becomes wire 16, is directed through the dies by the successive wire pulling capstans 14 of the machine, the wire wrapping around the capstans one or more times in the process of traveling between adjacent dies. The capstans of 12 are driven at a rate of speed greater than the rate at which the wire reaches and leaves the capstans so that the capstans slip positively within the turns of wire on the capstans. The slip rate is set by the speed of the final capstan 19 (FIG. 1), capstan 19 setting the overall speed of the process of the invention. Before the wire reaches the last die 18A of the series of dies 18, however, the wire leaves the machine and is pulled over sheave 29, and through die 28, by capstan 24 and the pull of the sheaves 34 and 36 of annealer 20. Die 28 removes oil and any foreign matter adhering to the surface of the wire leaving the last capstan of machine 12. Capstan 24, in turn, directs the wire to the first sheave 34 of annealer 20 at the proper tension, capstan 24 providing the major part of pulling force on the wire in die 28, as explained earlier, while the sheaves of the annealer provide a minor portion of the total pulling force for 28.

Like the capstans 14 of drawing machine 12, the sheaves 34 and 36 (FIG. 2) of annealer 20 are driven faster (by drive motors not shown) than the rate at which wire 16 engages and leaves the sheaves, and at a rate that is preset and proportional to the main line speed, as set by capstan 19. This results in relative positive slipping between the wire and each sheave, i.e. slippage of each sheave against the wire, such that any oxide on the wire and sheave is rubbed away to thereby provide good electrical contact between them. As indicated earlier, the sheaves are an integral part of an electrical system that supplies the portion of the wire extending between them, at any given instant of time, as the wire travels between sheaves 34 and 36, with the electrical current provided by power supply 32. The amount of this current and the duration of time at which the length of the wire is located between the sheaves are sufficient to heat the wire to annealing temperature. This is true even when the wire travels at maximum production speeds.

After the annealing process of 20 wire 16 begins a progressive quenching process in the compartments of 38 and 39 of 22. In the quenching process, the traveling wire is successively cooled to a predetermined temperature level, which level is substantially above a "cold" or room temperature value when the wire leaves the last compartment 39. Hence, when the wire reaches die 18A, the wire will have metallurgical properties suitable for working by the final draw of the wire in die 18A, as well as collection by an accumulator 56 if used, and takeup reel 58, without coldworking and hence without rehardening of the wire. The final draw at 18A works the wire such that it is rehardened if the temperature of the wire does not provide it with suitable properties for working. Similarly, an accumulator and takeup reel work the wire in the process of collection, as collection involves physically wrapping the wire around such structures, though an accumulator is not always necessary in a collecting process. The accumulator is not needed when the final capstan 19 and the takeup reel 58 are controlled in a manner that provides constant tension on the wire as it is reeled on 58. In any case, by controlling the temperature of wire issuing from the quenching means, and from die 18A, the wire is processed in a relatively hot condition so as to minimize cold-working of the wire.

The relatively high temperature of wire 16 after the quenching process is also helpful for drying purposes, though water removing apparatus, such as air nozzles 53, has been found necessary to insure a completely dry wire for drawing at 18A. Water and moisture prevent proper wetting of the wire with oil for lubrication of the final draw, and without proper lubrication, the wire will tend to break in the die.

This is all accomplished by sensing the speed of wire travel and the temperature of the wire after it leaves the quenching process, and controlling the cooling effected by the quenching process in response to the speed and temperature sensed. In FIG. 2, as indicated earlier, control of wire temperature is effected by control of individual valves 43 supplying water to the quenching compartments. When the process is started, the temperature of the wire is at room temperature, and the speed of the wire begins, of course, at zero speed. The speed increases therefrom to a steady-state run speed in a period of time dependent upon the rate of rotation of final capstan 19 (FIG. 1). Controller 50 receives signals from tachometer converter 48 indicative of the increasing speed, and outputs signals to valves 43 that order only a limited amount of wire quenching to allow wire temperature to quickly reach steady-state temperature preset in controller 50. The controller is also receiving signals from sensing device 52, but does not utilize these signals until the wire attains a steady-state or run speed.

When the speed of the wire reaches a steady-state or run speed, controller 50 then operates on the basis of the signals received from sensor 52. When 52 senses a change in the steady-state temperature of the wire that is outside of the limits that are set in 50, 50 orders a change in valves 43 in a manner that changes the volume of the water supplied to the quenching stages until wire temperature returns to a value within the preset limits. In this manner, the wire leaving the last quenching stage will be of a temperature that will provide a relatively hot wire for working at 18A and for collection at 56 and 58 to avoid cold-working and hence rehardening of the wire.

As explained above, the entire process of the invention takes place within the operating parameters and profile of a slip-drawing machine, and under the single control of a final capstan 19 driven by the machine. For this reason, no complicated control mechanism is required to synchronize the capstans of the machine and the sheaves of the annealer. Such slip means function only in response to the demand of capstan 19, i.e. if 19 slows, the rate of wire travel immediately slows; if the speed of 19 increases, the slipping capstans and sheaves respond immediately to increase the rate of travel of the wire.

While the invention has been described in terms of preferred embodiments, the claims appended hereto are intended to encompass all embodiments which fall within the spirit of the invention.

What is claimed is:

1. Apparatus for successively slip drawing, annealing and quenching non-ferrous wire comprising:

a machine for continuously drawing wire by directing the same through a plurality of successive wire drawing dies using a plurality of capstans upon which turns of the wire are wound, the capstans slipping within the turns of wires in the process of directing wire to the dies, means for continuously annealing wire, means for directing the wire from the machine to the annealing means before the wire reaches the last die of the plurality, including means independent of the slip of the drawing machine to control tension on the wire entering the annealing means, means for continuously quenching the wire after it leaves the annealing means, means for controlling the rate of cooling in the quenching means and thus the temperature of the wire leaving the quenching means, such that the wire leaving the quenching means has a predetermined temperature value, means for continuously returning the wire from the quenching means to the drawing machine for final drawing of the wire in the machine, and a last die for finally drawing the wire in the machine and within the slip profile of the machine.

2. The apparatus of claim 1 in which the means for directing the wire to the annealing means includes a die for removing drawing lubricant from the wire before it reaches the annealing means, and a capstan driven in a manner that provides a portion of the force for pulling the wire through the die.

3. A method of continuously and successively slip drawing, annealing and quenching non-ferrous wire, the method comprising the steps of:

directing the wire successively through a plurality of drawing dies of a continuous, wire drawing machine using a plurality of capstans upon which turns of the wire are wound, the capstans slipping within the turns in the process of directing wire to the dies, directing the wire from the machine to and through apparatus for continuously annealing the wire before the wire reaches the last die of the plurality, annealing the wire in the apparatus, assisting delivery of the wire to the annealing apparatus in a manner independent of the slip of the drawing machine, directing annealed wire from the apparatus to a quenching structure and quenching the wire in said structure, controlling the degree of quenching of the wire in a manner that provides the wire with a predetermined temperature when the wire leaves the structure, and returning annealed wire to the slip drawing machine at a location therein before the last die of the plurality for final drawing of the wire in the machine.

* * * * *